US006866481B2

(12) United States Patent
Chiang et al.

(10) Patent No.: US 6,866,481 B2
(45) Date of Patent: Mar. 15, 2005

(54) VENTILATOR HAVING AN OPTIMUM FAN STRUCTURE

(76) Inventors: Chao-Cheng Chiang, 335, Ta Lin Rd., Ta Ya Hsiang, Taichung Hsien (TW); Chi-Hsiung Chiang, 335, Ta Lin Rd., Ta Ya Hsiang, Taichung Hsien (TW)

( * ) Notice: Subject to any disclaimer, the term of this patent is extended or adjusted under 35 U.S.C. 154(b) by 15 days.

(21) Appl. No.: 10/336,773

(22) Filed: Jan. 2, 2003

(65) Prior Publication Data

US 2004/0131468 A1 Jul. 8, 2004

(51) Int. Cl.[7] ..... F04D 29/30
(52) U.S. Cl. ..... 416/178; 416/186 R
(58) Field of Search ..... 416/186 R, 187, 416/178, 214 R, 219 R, 221, 228

(56) References Cited

U.S. PATENT DOCUMENTS

| | | | | |
|---|---|---|---|---|
| 1,730,372 | A | 10/1929 | Lawrie | 416/187 |
| 1,781,165 | A | 11/1930 | Criqui | 416/187 |
| 1,876,518 | A | 9/1932 | Mathis | 29/889.3 |
| 1,876,871 | A | 9/1932 | Doman | 416/187 |
| 2,224,617 | A | 12/1940 | Sylvan | 416/187 |
| 2,803,398 | A | 8/1957 | Sprouse | 416/187 |
| 3,368,744 | A | 2/1968 | Jenn | 416/237 |
| 3,394,876 | A | 7/1968 | Eck | 416/178 |
| 5,988,979 | A | 11/1999 | Wang | 416/178 |

FOREIGN PATENT DOCUMENTS

| | | | |
|---|---|---|---|
| JP | 58035296 A | 3/1983 | F04D/29/28 |

*Primary Examiner*—Edward K. Look
*Assistant Examiner*—Igor Kershteyn
(74) *Attorney, Agent, or Firm*—Charles E. Baxley

(57) ABSTRACT

A ventilator fan structure includes a disk-shaped seat, an annular plate, and a plurality of blades. Each of the blades is arranged in an oblique manner along a rotational direction of the fan structure and has a primary blade portion and a secondary blade portion with different widths, thereby enhancing the suction force of each of the blades for the oil and smoke. Thus, the fan structure enhances the air drainage rate of the ventilator and reduces noise during operation of the ventilator.

7 Claims, 4 Drawing Sheets

VENTILATOR HAVING AN OPTIMUM FAN STRUCTURE

BACKGROUND OF THE INVENTION

1. Field of the Invention

The present invention relates to a ventilator having an optimum fan structure, and more particularly to a ventilator having an optimum fan structure that enhances the air drainage rate of the ventilator and reduces noise during operation of the ventilator.

2. Description of the Related Art

The ventilator usually comprises a fan motor that is operated at a high rotational speed, so as to drain the oily smoke contained in the kitchen outward, thereby achieving the ventilating effect. A conventional ventilator comprises a fan structure including a plurality of arc-shaped blades that are rotated by the fan motor to produce a suction force for sucking the oily smoke so as to drain the oily smoke outward. However, each of the blades has a fixed curvature, so that the suction force produced by the blades is limited, thereby decreasing the air drainage rate of the ventilator. In addition, each of the blades has a bottom formed with a right angle, thereby easily producing noise during operation of the ventilator.

SUMMARY OF THE INVENTION

The present invention has arisen to mitigate and/or obviate the disadvantage of the conventional ventilator fan structure.

The primary objective of the present invention is to provide a ventilator having an optimum fan structure, wherein the suction force produced by the blades is increased, thereby enhancing the air drainage rate of the ventilator.

Another objective of the present invention is to provide a ventilator having an optimum fan structure, wherein the oily smoke drained from each of the blades is moved upward in a circulating and winding manner to prevent the oily smoke from directly hitting the air box, thereby preventing from incurring noise during operation of the ventilator.

A further objective of the present invention is to provide a ventilator having an optimum fan structure, wherein each of the blades is arranged in an oblique manner along the rotational direction of the fan structure, and each of the blades has a primary blade portion and a secondary blade portion with different widths, thereby enhancing the suction force of each of the blades for the oil and smoke.

In accordance with the present invention, there is provided a ventilator fan structure, comprising a disk-shaped seat, an annular plate, and a plurality of blades, wherein:

each of the blades is mounted between the disk-shaped seat and the annular plate and is arranged in an oblique manner along a rotational direction of the fan structure, each of the blades has an upper section formed with a primary blade portion and a lower section formed with a secondary blade portion, and the primary blade portion of each of the blades has a width greater than that of the secondary blade portion.

Further benefits and advantages of the present invention will become apparent after a careful reading of the detailed description with appropriate reference to the accompanying drawings.

DETAILED DESCRIPTION OF THE INVENTION

Figure 1:
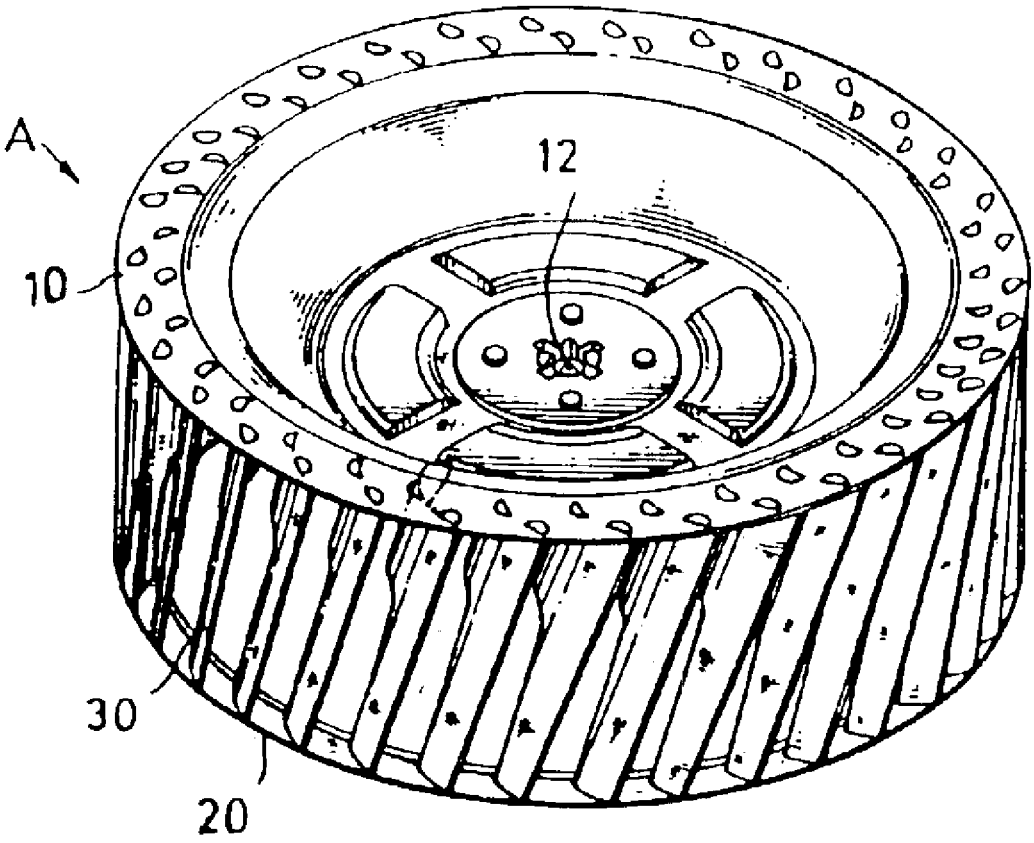
FIG. 1 is a perspective view of a fan structure of a ventilator in accordance with a preferred embodiment of the present invention.

Referring to the drawings and initially to FIGS. 1–4, an optimum fan structure A of a ventilator in accordance with a preferred embodiment of the present invention comprises a disk-shaped seat 10, an annular plate 20, and a plurality of blades 30.

The disk-shaped seat 10 has an outer annular portion formed with a plurality of positioning holes 11. The disk-shaped seat 10 has a center formed with a shaft hole 12 for securing a propeller shaft (not shown) of a fan motor (not shown), so that the fan structure A can be rotated by the propeller shaft of the fan motor.

The annular plate 20 is mounted on a bottom of the disk-shaped seat 10. The annular plate 20 is formed with a plurality of positioning holes 21.

Each of the blades 30 is mounted between the disk-shaped seat 10 and the annular plate 20. Each of the blades 30 has an upper end formed with a positioning lug 31 secured in a respective one of the positioning holes 11 of the disk-shaped seat 10. Each of the blades 30 has a lower end formed with a positioning lug 310 secured in a respective one of the positioning holes 21 of the annular plate 20.

In practice, each of the blades 30 is mounted between the disk-shaped seat 10 and the annular plate 20 and is arranged in an oblique manner along a rotational direction of the fan structure A with a determined included angle defined between each of the blades 30 and the rotational direction of the fan structure A. In addition, each of the blades 30 has an upper section formed with a primary blade portion 32 and a lower section formed with a secondary blade portion 33. The primary blade portion 32 of each of the blades 30 has a width greater than that of the secondary blade portion 33.

In addition, the primary blade portion 32 of each of the blades 30 has an outer side formed with a first arc-shaped portion B and an inner side formed with a second arc-shaped portion C. The first arc-shaped portion B has a curvature greater than that of the second arc-shaped portion C. The curvature of the primary blade portion 32 of each of the blades 30 is gradually reduced from the first arc-shaped portion B to the second arc-shaped portion C.

The secondary blade portion 33 of each of the blades 30 is extended downward from the first arc-shaped portion B of the primary blade portion 32 of each of the blades 30. The secondary blade portion 33 of each of the blades 30 has a width substantially equal to that of the annular plate 20. In addition, the annular plate 20 has an inner side formed with a catch flange 22, and the secondary blade portion 33 of each of the blades 30 is rested on the catch flange 22 of the annular plate 20, thereby preventing the oil on each of the blades 30 from leaking outward. In addition, the inner side of the primary blade portion 32 of each of the blades 30 has a distal end formed with a bent portion 34 for guiding the oil.

Figure 2:
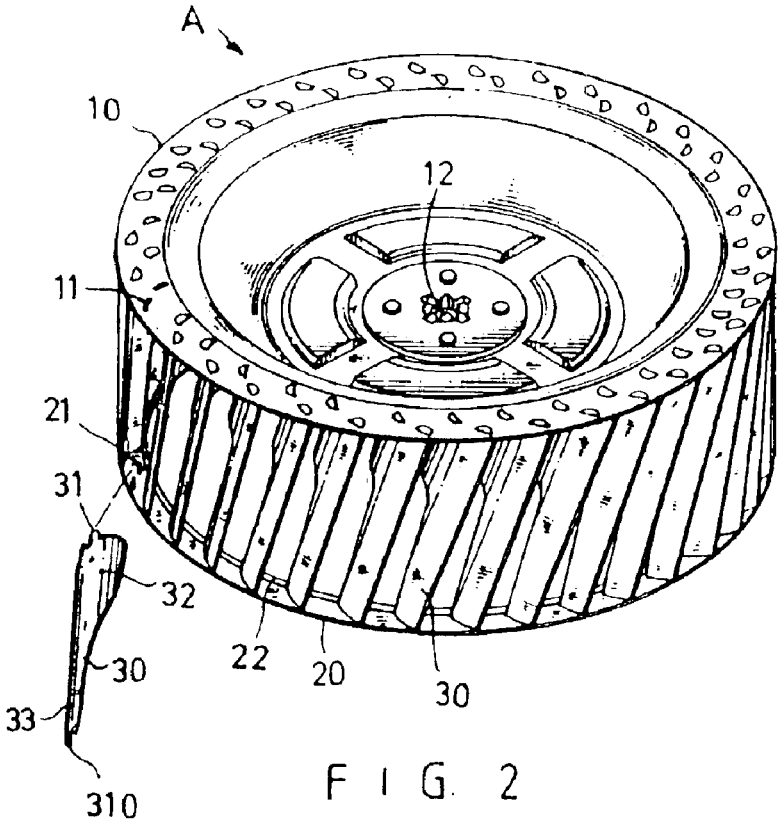
FIG. 2 is a partially exploded perspective view of the fan structure of the ventilator in accordance with the preferred embodiment of the present invention.
Figure 3:
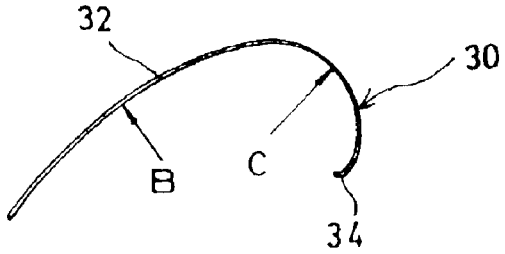
FIG. 3 is a schematic top plan view of a blade of the fan structure of the ventilator in accordance with the preferred embodiment of the present invention.
Figure 4:
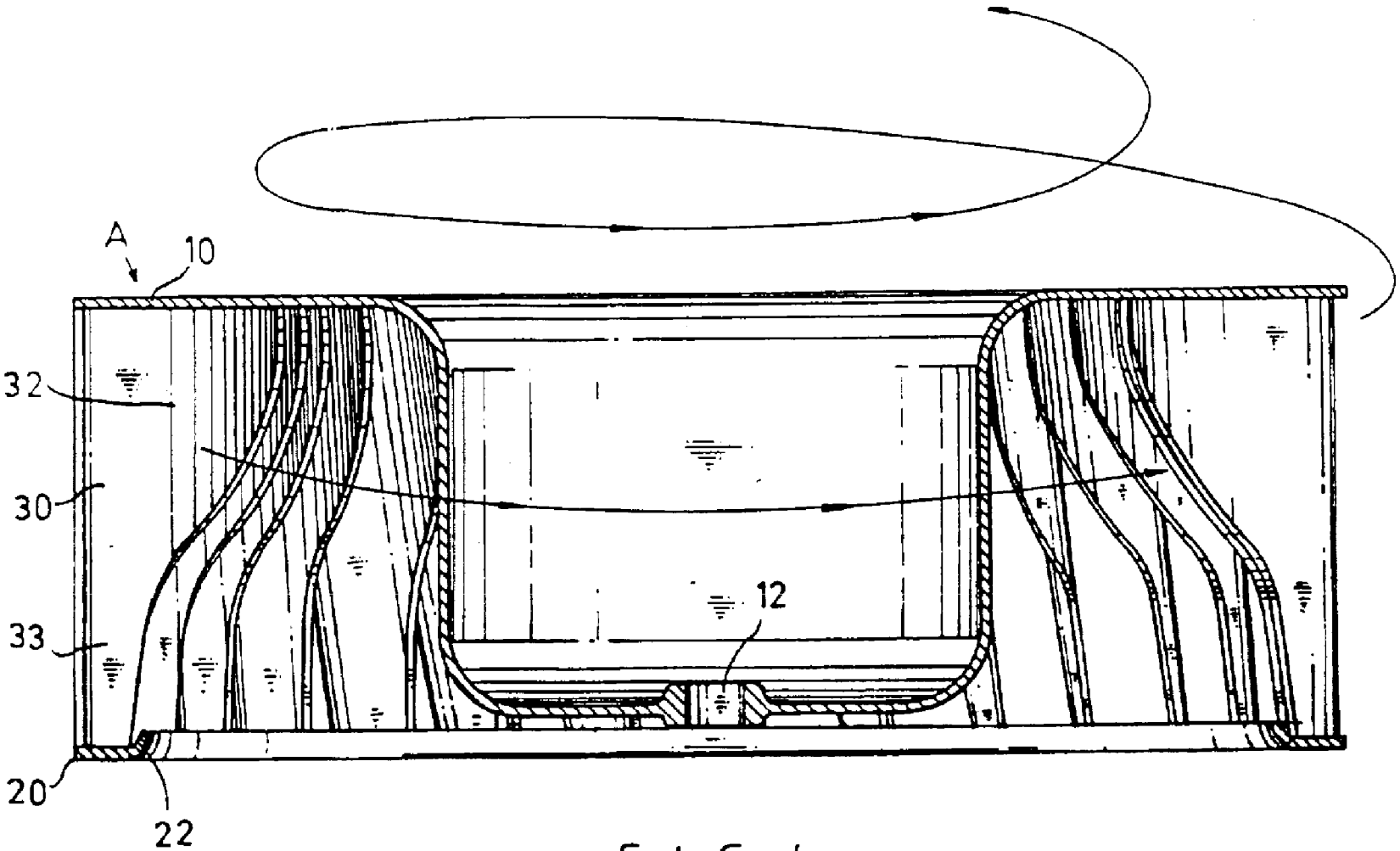
FIG. 4 is a side plan cross-sectional view of the fan structure of the ventilator as shown in FIG. 1.
Figure 5:
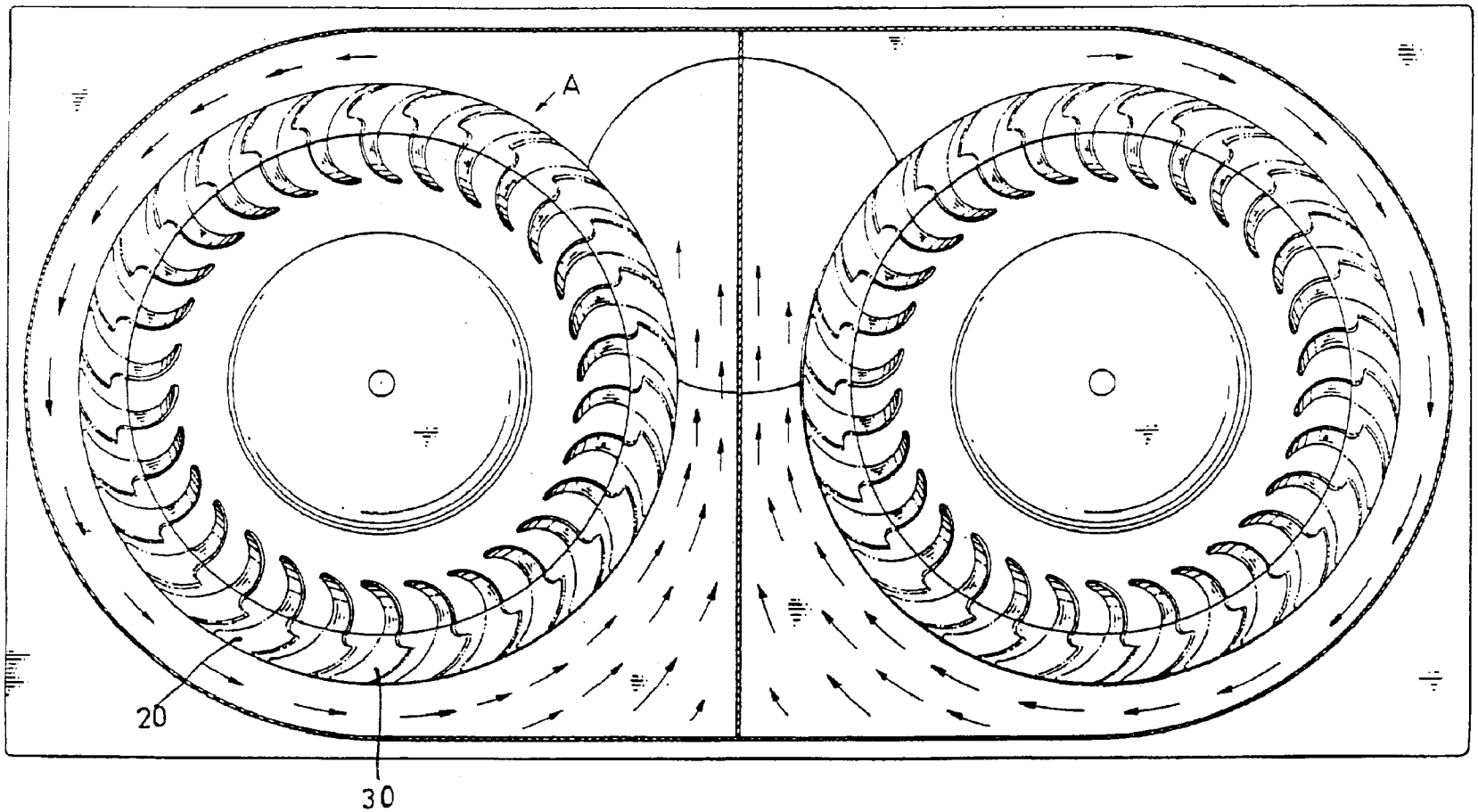
FIG. 5 is a bottom plan operational view of the fan structure of the ventilator in accordance with the preferred embodiment of the present invention.

In operation, referring to FIGS. 4 and 5 with reference to FIGS. 1–3, each of the blades 30 is arranged in an oblique manner along the rotational direction of the fan structure A, and each of the blades 30 has a primary blade portion 32 and a secondary blade portion 33 with different widths, thereby enhancing the suction force of each of the blades 30 for the oil and smoke, and thereby enhancing the air drainage rate. In addition, the oily smoke drained from each of the blades 30 is moved upward in a circulating and winding manner as shown FIGS. 4 and 5, to prevent the oily smoke from directly hitting the air box (not shown), thereby preventing from incurring noise during operation of the ventilator.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A ventilator fan structure, comprising:

a disk-shaped seat including an outer annular portion formed with a plurality of positioning holes, an annular plate formed with a plurality of positioning holes, and a plurality of blades mounted between the disk-shaped seat and the annular plate, and arranged along a rotational direction of the fan structure, each of the blades including an upper end formed with a plurality of positioning lugs secured in the positioning holes of the disk-shaped seat, and including a lower end formed with a plurality of positioning lugs secured in the positioning holes of the annular plate, each of the blades including an upper section formed with a primary blade portion, and a lower portion formed with a secondary blade portion which includes a width substantially equal to that of the annular plate, and the primary blade portion of each of the blades including a width greater than that of the secondary blade portion.

2. The ventilator fan structure according to claim 1, wherein the primary blade portion of each of the blades has an outer side formed with a first arc-shaped portion and an inner side formed with a second arc-shaped portion.

3. The ventilator fan structure according to claim 2, wherein the first arc-shaped portion has a curvature greater than that of the second arc-shaped portion.

4. The ventilator fan structure according to claim 2, wherein the curvature of the primary blade portion of each of the blades is reduced from the first arc-shaped portion to the second arc-shaped portion.

5. The ventilator fan structure according to claim 2, wherein the secondary blade portion of each of the blades is extended downward from the first arc-shaped portion of the primary blade portion of each of the blades.

6. The ventilator fan structure according to claim 1, wherein the annular plate has an inner side formed with a catch flange, and the secondary blade portion of each of the blades is rested on the catch flange of the annular plate.

7. The ventilator fan structure according to claim 1, wherein the primary blade portion of each of the blades has an inner side having a distal end formed with a bent portion.

* * * * *